US008375465B2

(12) United States Patent
Whaley

(10) Patent No.: US 8,375,465 B2
(45) Date of Patent: Feb. 19, 2013

(54) DRAG INDUCING SWIMWEAR

(76) Inventor: Patrick Gerald Whaley, Cumming, GA (US)

( * ) Notice: Subject to any disclaimer, the term of this patent is extended or adjusted under 35 U.S.C. 154(b) by 303 days.

(21) Appl. No.: 12/508,237

(22) Filed: Jul. 23, 2009

(65) Prior Publication Data

US 2010/0017931 A1 Jan. 28, 2010

Related U.S. Application Data

(60) Provisional application No. 61/082,938, filed on Jul. 23, 2009.

(51) Int. Cl.
*A41D 7/00* (2006.01)

(52) U.S. Cl. ..... 2/67; 2/69

(58) Field of Classification Search ..... 2/67, 108, 2/238, 2.15, 2.16, 115, 239; 482/55
See application file for complete search history.

(56) References Cited

U.S. PATENT DOCUMENTS 1,128,682 A * 2/1915 Homewood ..... 441/59
1,962,984 A * 6/1934 Crego ..... 2/67
2,075,945 A * 4/1937 Hurt ..... 2/67
3,142,485 A 7/1964 Jacobsen
3,436,762 A * 4/1969 Cahan ..... 2/67
4,179,754 A * 12/1979 Denu ..... 2/67
4,302,007 A * 11/1981 Oprean et al. ..... 482/55
4,343,044 A * 8/1982 Borda et al. ..... 2/67
4,538,615 A * 9/1985 Pundyk ..... 450/131
4,654,894 A * 4/1987 Kudo ..... 2/67
4,853,976 A * 8/1989 Mertz ..... 2/67
4,916,755 A * 4/1990 Feigenbaum et al. ..... 2/67
4,956,878 A * 9/1990 Boynton ..... 2/67
4,999,845 A * 3/1991 Jenks et al. ..... 2/2.16
5,002,268 A 3/1991 Anderson
5,011,137 A 4/1991 Murphy
5,033,116 A * 7/1991 Itagaki et al. ..... 2/67
5,282,277 A * 2/1994 Onozawa ..... 2/69
5,367,708 A * 11/1994 Fujimoto ..... 2/22
5,487,710 A * 1/1996 Lavorgna et al. ..... 482/55
5,742,936 A * 4/1998 Tronc ..... 2/2.15
5,768,703 A * 6/1998 Machado et al. ..... 2/2.15
5,913,408 A * 6/1999 Shanahan ..... 2/90
6,484,319 B1 * 11/2002 Fusco et al. ..... 2/67
6,546,560 B2 * 4/2003 Fusco et al. ..... 2/67
7,104,932 B1 9/2006 Brentlinger
2002/0152531 A1 * 10/2002 Fusco et al. ..... 2/2.15
2004/0221355 A1 * 11/2004 Garcia ..... 2/67
2008/0141430 A1 * 6/2008 Rance et al. ..... 2/67
2008/0256675 A1 * 10/2008 Di Lorenzo ..... 2/67
2009/0038047 A1 * 2/2009 Di Lorenzo ..... 2/67
2010/0212057 A1 * 8/2010 Sullivan ..... 2/2.11

* cited by examiner

*Primary Examiner* — Shelley Self
*Assistant Examiner* — Richale Quinn
(74) *Attorney, Agent, or Firm* — Jihan A. R. Jenkins, Esq.; Benjamin C. Wiles, Esq.; Troutman Sanders LLP

(57) ABSTRACT

An exercise and training device for swimmers in the form of a shirt, top, or singlet that, due to the material of manufacture, increases the resistance to the swimmer's movement through the water.

18 Claims, 2 Drawing Sheets

DRAG INDUCING SWIMWEAR

STATEMENT OF RELATED APPLICATIONS

This patent application is based on and claims the benefit of U.S. Provisional Patent Application No. 61/082,938 having a filing date of 23 Jul. 2008, which is incorporated herein in its entirety by this reference.

BACKGROUND OF THE INVENTION

1. Technical Field

The present invention generally relates to exercise clothing and more specifically relates to drag inducing swimwear for wearing during an exercise regimen.

2. Prior Art

People, especially athletes, when exercising often prefer to push themselves harder when training so as to allow them to better compete. For example, many athletes carry additional weights when training. Wrist and ankle weights are available for wearing bracelet-like and anklet-like, respectively, to provide for extra effort when moving the arms and legs, respectively, during running or other motion exercises, for increasing the strength and stamina of the arms and legs. For another example, baseball players often add weights to bats when taking practice swings both to make the bat feel lighter when actually swinging at a pitch and to build arm muscles. For another example, people, especially members of the armed forces, often wear weighted backpacks or backpacks containing weights when walking or hiking, for increasing the strength and stamina of the legs and torso. Carrying such extra weight can increase the effort of the muscles, thus increasing the strength and stamina of the muscles upon continued use of the extra weights. Weighted clothing also exists for the same purpose.

Various inventions have been made to help swimmers train or compete. U.S. Pat. No. 3,142,485 is an external device that can potentially get in the way of the swimmers motion. This devices does not allow for freedom of movement, and thereby does not allow the swimmer to swim naturally or to complete flip turns. U.S. patent application Ser. No. 10/755,606 is a design that does not allow for continued resistance. U.S. Pat. No. 5,002,268 is a device that may get in the way of a swimmer's normal swimming motion and is not good for all strokes or for completing the flip turns. U.S. Pat. No. 5,011,137 is a device that could get caught between the swimmer's legs during breast stroke, in turn making it less universal. U.S. Pat. No. 5,033,116 is a device that reduces fluid resistance. U.S. Pat. No. 6,546,560 helps a wearer swim faster by reducing resistance and it does not add resistance and it is not for training. U.S. Pat. No. 7,104,932 is a device that can not be worn by multiple swimmers in the same lane and does not allow the swimmer to achieve the same feel of normal swimming.

Although these prior art inventions may have some utility, there is room for improvement. For example, to the swimmer, carrying extra weight may not be desirable or advantageous, as there is a risk of drowning should the swimmer be overburdened by the weight. As such, there is a need for an article of clothing that can be worn on the torso, such as a shirt, top, or singlet, that increases the muscle burden on a swimmer during training yet does not overly interfere with the movement of the wearer. The present invention is directed to such needs.

BRIEF SUMMARY OF THE INVENTION

Briefly, the present invention is an exercise and training device for swimmers in the form of an article of clothing, such as a shirt, top, or singlet that, due to the material of manufacture, increases the resistance to the swimmer's movement through the water and thus helps at least in increasing lung capacity due to the additional effort needed by the swimmers and in the development of the swimming muscles. The substrate clothing can be made of natural or synthetic materials, such as but not limited to cotton, linen, wool, polyester, NYLON®, LYCRA®, SPANDEX®, and combinations and blends. Use of a relatively thin material can add to the comfort of the wearer and can reduce interference with the wearer's natural swimming motion. Preferably, the material of manufacture of the substrate clothing is a lightweight, soft, comfortable material that is generally form-fitting to the wearer's body, and that can be elastic or contain elastic for this purpose.

The substrate clothing can have the general shape of a common long-sleeved tee-shirt or singlet. Preferably, the substrate clothing is a long-sleeved shirt that has thumb slits, loops or the equivalent on the hand end of the sleeve for looping over at least one finger so as to prevent the sleeve from riding or traveling up the arm during use. Alternatively, the substrate clothing is a long-sleeved singlet that (combined top and bottom) can be worn over or in place of a normal swimming suit that also has thumb slits, loops or the equivalent on the hand end of the sleeve for looping over at least one finger so as to prevent the sleeve from riding or traveling up the arm during use.

Other features, aspects, and advantages of the invention will become apparent from the following detailed description of the preferred embodiments, taken in conjunction with the accompanying drawings in which like reference numerals represent like components throughout the several views, illustrating by way of example the principles of the invention.

DETAILED DESCRIPTION OF THE PREFERRED EMBODIMENTS

Figure 2:
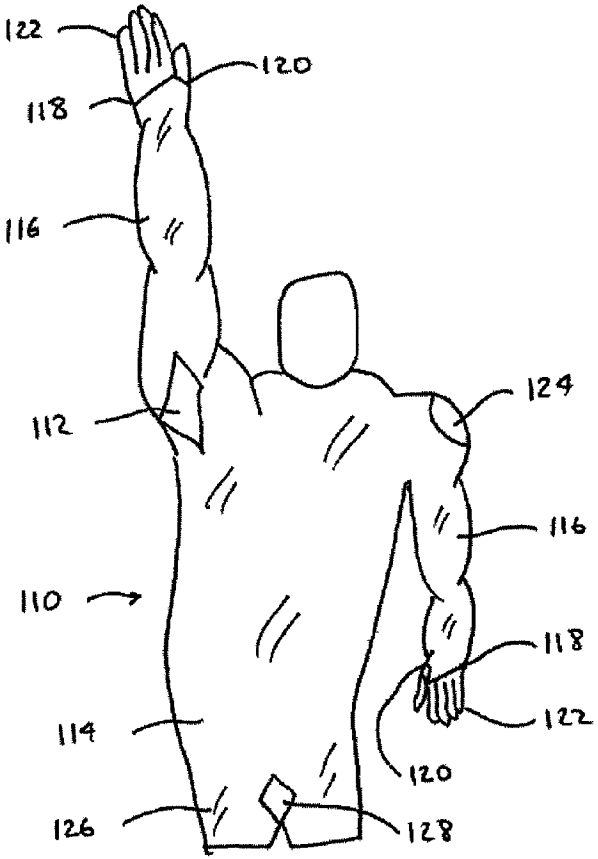
FIG. 2 is a front view of a second embodiment of the invention.
Figure 1:
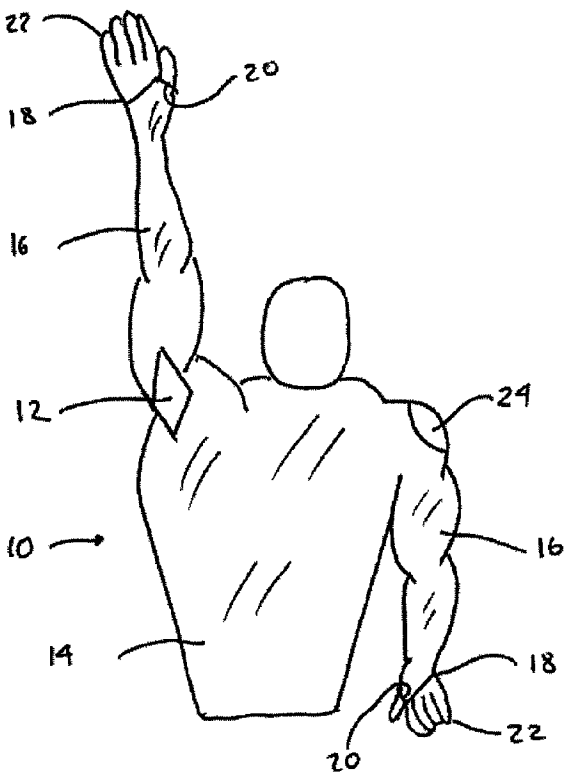
FIG. 1 is a front view of a first embodiment of the invention.
Figure 3B:
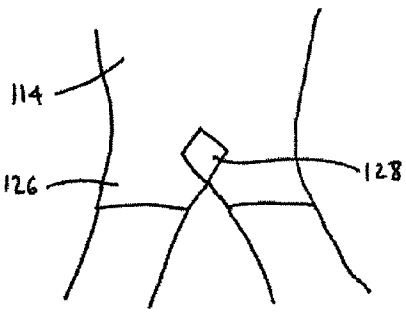
FIGS. 3A-3D are front views of illustrative the pant portions of the invention, with FIG. 3A showing a bikini design, FIG. 3B showing a short leg design, FIG. 3C showing a mid leg design, and FIG. 3D showing a long leg design.
Figure 3A:
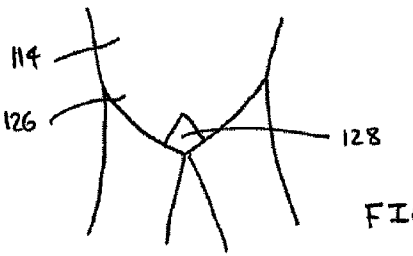
Figure 3D:
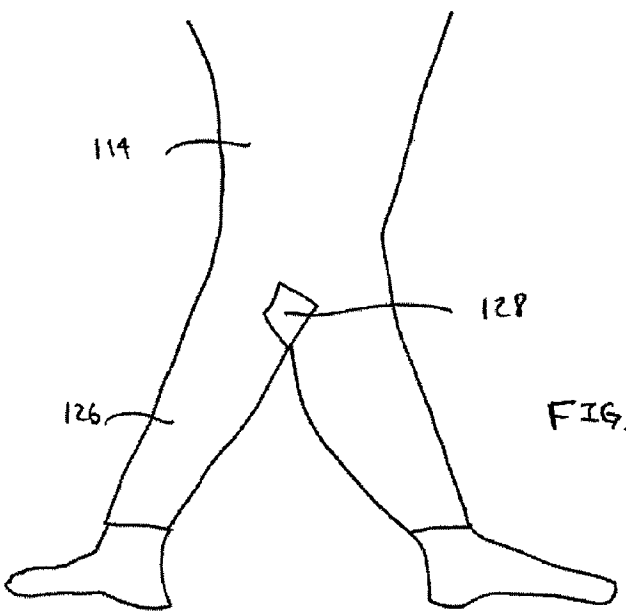
Figure 3C:
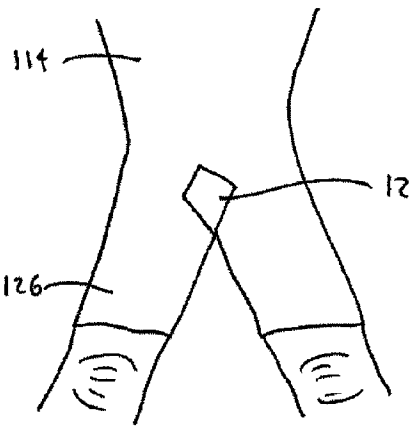

FIG. 1 is a front view of a first embodiment of the invention illustrating a long-sleeved top. FIG. 2 is a front view of a second embodiment of the invention illustrating a long-sleeved singlet. Both of these illustrative embodiments comprise thumb slits or finger loops for preventing the sleeve from riding or traveling up the arm during use. FIGS. 3A-3D are front views of illustrative the pant portions of the invention, with FIG. 3A showing a bikini design, FIG. 3B showing a short leg design, FIG. 3C showing a mid leg design, and FIG. 3D showing a long leg design.

Referring now to FIG. 1, a first illustrative embodiment of the invention is shown. Preferably, this embodiment of the invention is a tight fit cotton-based stretch fabric top 10. As can be seen, the top 10 comprises a body 14 and sleeves 16 in a torso-fitting configuration. The hand end 18 of the sleeves 16 comprise a loop or thumb slit 20 for fitting over at least one of the wearer's fingers 22 for preventing the sleeves 16 from riding or traveling up the wearer's arms during use. The armpit 12 region of the top 10 can be the same material as, or a different material than, the rest of the top 10. Preferably, the armpit 12 region is an extremely elastic fabric for the so as to not hinder the swimmer's movement. Such an armpit 12 region material can be manufactured into the top 10 in conventional known manners. Additionally, other extremely elastic regions can be included, such as on the top of the shoulder 24 for a similar purpose.

Referring now to FIG. 2, a second illustrative embodiment of the invention is shown. Preferably, this embodiment of the invention is a tight fit cotton-based stretch fabric singlet 110. As can be seen, the singlet 110 also comprises a body 114 and sleeves 116 in a torso-fitting configuration, but also comprises a pant 126 portion. As shown in FIGS. 3A-3D, the pant 126 portion can be structured in a bikini design (FIG. 3A), a short leg design (FIG. 3B), a mid leg design (FIG. 3C), a long leg design (FIG. 3D), or other designs (not shown). The pant 126 portion preferably is made from the same material as the body 114 and sleeves. The hand end 118 of the sleeves 116 comprise a loop or thumb slit 120 for fitting over at least one of the wearer's fingers 122 for preventing the sleeves 116 from riding or traveling up the wearer's arms during use. The armpit 112 region of the singlet 110 can be the same material as, or a different material than, the rest of the singlet 110. Preferably, the armpit 112 region is an extremely elastic fabric for the so as to not hinder the swimmer's movement. Such an armpit 112 region material can be manufactured into the singlet 110 in conventional known manners. Additionally, other extremely elastic regions can be included, such as on the top of the shoulder 124 or the crotch 128 for a similar purpose.

The preferred cotton-based stretch fabric is selected to exert enough drag resistance to the water for the swimmer without getting in the path of the hands or other movements of the swimmer. Such drag resistance coupled with non-interference to the swimmer's motion is an important aspect of the design. The preferred fabrics exert a drag resistance to the water even in flip turns, but does not interfere with the flip turns, unlike known prior art. This also is an important aspect of the design, as because races often are won and lost on flip turns, it is important that the swimmer is able to practice flip turns without any undue interference. The preferred fabric can be either single or double layered.

In use, the drag coefficient of the material of manufacture of the swimwear 10, 110 is larger than the drag coefficient of, for example, typical swimwear or racing swimwear, or the wearer's skin. The wearer puts on the swimwear 10, 110 in a manner similar to putting on a common top or singlet, and engages in a desired regimen. The extra drag created by the swimwear 10, 110 relative to the water increases the muscle exertion by the wearer, thus both giving the wearer a workout with greater exertion and potentially increasing the muscle mass and stamina, as well as potentially increasing lung capacity and the development of the swimming muscles due to the additional effort needed by the swimmers. The preferred elastic and close-fitting design of the swimwear does not interfere unduly with the wearer's natural swimming motions, including flip turns. The preferred extremely elastic armpit 12 and crotch 128 regions (and other regions, if desired) adds to the wearer's ability to have a natural swimming stroke and complete flip turns, and adds to the comfort of the swimwear 10, 110.

A difference in the present invention relative to the prior art is that the present invention is a tight-fitting preferably elastic fabric that stays close to the wearer's body. Regular cotton and other natural materials stretch in the water, thereby getting in the way of the swimmer's stroke and also increasing the wearer's consciousness of the swimwear 10, 110. With increased wearer consciousness of the swimwear 10, 110, the wearer may subconsciously alter their stroke. Thus, the swimwear 10, 110 is designed so there will be very little movement with respect to the wearer's body. By decreasing the wearer's awareness of the swimwear 10, 110, the resistance training will have even more effect by allowing the wearer to concentrate on their form and not on the swimwear 10, 110.

The wearing of the swimwear 10, 110 is obvious from its structure. Because of the described features of the swimwear 10, 110, a wearer can easily and quickly put it on in a manner similar to putting on a common tee-shirt or singlet. It is understood by persons of ordinary skill in the art that the optimal dimensions and sizes for the invention depend on the size of the wearer, manufacturing materials, and aesthetics or design, just like any other piece of clothing. Such parameters for the present invention can be determined without undue experimentation. For example, preferably, the swimwear 10, 110 is made of a material, or thickness of material, that does not absorb or retain enough water to cause the wearer to sink.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. An article of swimwear for increasing resistance to a wearer's movement through water when being worn and used by the wearer relative to the wearer not wearing and using the article of swimwear, the article comprising:

a torso portion covering the stomach and back of the wearer, a majority of the torso portion made from a first material, the first material comprising a water resistance inducing substrate wherein the increased resistance caused by wearing and using the article of swimwear increases the physical effort needed by the wearer when swimming relative to the wearer not wearing and using the article of swimwear;

long sleeves for covering the wearer's arms, the long sleeves comprising means for fitting over and engaging at least one of the wearer's fingers for preventing the sleeves from traveling up the wearer's arms during use; and wherein the torso portion further comprises an armpit region and a shoulder region; the torso portion except for the armpit region and the shoulder region is made from the first material having a first elasticity, and the armpit region and the shoulder region are made from a second material having a second elasticity, wherein the second elasticity is greater than the first elasticity; and wherein the armpit region and the shoulder region are distinct portions of the second material separated by a portion of the first material.

2. The article of swimwear as claimed in claim 1, further comprising a pant portion also made from the first material comprising the water resistance inducing substrate.

3. The article of swimwear as claimed in claim 2, wherein: the pant portion further comprises a crotch region; and the pant portion except for the crotch region is made from the first material having the first elasticity and the crotch region is made from the second material having the second elasticity.

4. The article of swimwear as claimed in claim 3, wherein the second elasticity is greater than the first elasticity.

5. The article of swimwear as claimed in claim 3, wherein the first material comprising a water resistance inducing substrate is single layered.

6. The article of swimwear as claimed in claim 3, wherein the first material comprising a water resistance inducing substrate is double layered.

7. The article of swimwear as claimed in claim 3, wherein the torso portion and the pant portion are form-fitting to the wearer's body.

8. The article of swimwear as claimed in claim 1, wherein the first material comprising a water resistance inducing substrate is single layered.

9. The article of swimwear as claimed in claim 1, wherein the first material comprising a water resistance inducing substrate is double layered.

10. The article of swimwear as claimed in claim 1, wherein the torso portion is form-fitting to the wearer's body.

11. The article of swimwear as claimed in claim 1, wherein the long sleeves engage the wearer's thumb.

12. An article of swimwear for increasing resistance to a wearer's movement through water when being worn and used by the wearer relative to the wearer not wearing and using the article of swimwear, the article comprising:

a torso portion, a majority of the torso portion made from a first material comprising a water resistance inducing substrate, the torso portion further comprising an armpit region and a shoulder region, wherein the torso portion except for the armpit region and the shoulder region is made from the first material having a first elasticity, and the armpit region and the shoulder region are made from a second material having a second elasticity, the second elasticity being greater than the first elasticity, wherein the armpit region and the shoulder region are distinct portions of the second material separated by a portion of the first material, wherein the torso portion comprises long sleeves for covering the wearer's arms, the long sleeves comprising means for fitting over and engaging at least one of the wearer's fingers for preventing the sleeves from traveling up the wearer's arms during use, and wherein the increased resistance caused by wearing and using the article of swimwear increases the physical effort needed by the wearer when swimming relative to the wearer not wearing and using the article of swimwear.

13. The article of swimwear as claimed in claim 12, further comprising a pant portion, a majority of the pant portion also made from the first material comprising the water resistance inducing substrate, wherein the pant portion further comprises a crotch region and the pant portion except for the crotch region is made from the first material having the first elasticity and the crotch region is made from the second material having the second elasticity.

14. The article of swimwear as claimed in claim 13, wherein the first material comprising a water resistance inducing substrate is single layered.

15. The article of swimwear as claimed in claim 13, wherein the first material comprising a water resistance inducing substrate is double layered.

16. The article of swimwear as claimed in claim 12, wherein the first material comprising a water resistance inducing substrate is single layered.

17. The article of swimwear as claimed in claim 12, wherein the first material comprising a water resistance inducing substrate is double layered.

18. The article of swimwear as claimed in claim 12, wherein the long sleeves engage the wearer's thumb.

* * * * *